US008639145B2

(12) United States Patent
Hasegawa

(10) Patent No.: US 8,639,145 B2
(45) Date of Patent: Jan. 28, 2014

(54) IMAGE FORMING APPARATUS AND METHOD

(75) Inventor: Satoshi Hasegawa, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 274 days.

(21) Appl. No.: 13/281,758

(22) Filed: Oct. 26, 2011

(65) Prior Publication Data

US 2012/0107003 A1 May 3, 2012

Related U.S. Application Data

(60) Provisional application No. 61/409,952, filed on Nov. 3, 2010.

(51) Int. Cl.
*G03G 15/20* (2006.01)

(52) U.S. Cl.
USPC ..... 399/69

(58) Field of Classification Search
USPC ..... 399/38, 67–70, 122, 320, 328; 219/216, 219/619
See application file for complete search history.

(56) References Cited

U.S. PATENT DOCUMENTS 8,036,560 B2 * 10/2011 Otsuka ..... 399/70

FOREIGN PATENT DOCUMENTS

| | | |
|---|---|---|
| JP | 06-027756 | 2/1994 |
| JP | 2008-064861 | 3/2008 |
| JP | 2010-134130 | 6/2010 |

* cited by examiner

*Primary Examiner* — Hoan Tran
(74) *Attorney, Agent, or Firm* — Patterson & Sheridan, L.L.P.

(57) ABSTRACT

Certain embodiments provide an image forming apparatus including: a print process part; a heat roller including a heating element; a press roller including a heater; a power source part having a power upper limit value that is smaller than a sum of heating power for the heat roller and the press roller plus initial power and is larger than the heating power; a power source control part to control supply or stop of the initial power; a plurality of temperature sensors to detect respective roller temperatures; and a determination part to determine necessity of supplying the initial power by the power source control part based on a temperature difference between the respective roller temperatures.

20 Claims, 9 Drawing Sheets

TEMPERATURE(°C)
T1
T2
T0
THEATROLLER
TPRESSROLLER (I)
ON
(II)
(A)
(B)
TIME
POWER(W)
PLIMIT
L1
L2
HEAT ROLLER HEATING POWER
INITIALIZING POWER
HEAT ROLLER TEMPERATURE KEEPING POWER
PRESS ROLLER TEMPERATURE KEEPING POWER

PRESS ROLLER HEATING POWER
ELECTROPHOTOGRAPHIC PROCESS PART POWER
TIME

TEMPERATURE(°C)
T1
T2
T0
THEATROLLER
TPRESSROLLER

ON
(III)
(C)
(D)
TIME
POWER(W)
PLIMIT
INITIALIZING POWER
HEAT ROLLER HEATING POWER
PRESS ROLLER HEATING POWER
HEATROLLER TEMPERATURE KEEPING POWER
PRESSROLLER TEMPERATURE KEEPING POWER
ELECTROPHOTOGRAPHIC PROCESS PART POWER

TIME

IMAGE FORMING APPARATUS AND METHOD

CROSS-REFERENCE TO RELATED APPLICATION

The present application claims priority under 35 U.S.C. 119 to U.S. Provisional Application Ser. No. 61/409,952, to Hasegawa, filed on Nov. 3, 2010, the entire disclosure of which is incorporated herein by reference.

FIELD

Embodiments described herein relate generally to an image forming apparatus and an initial processing method of the image forming apparatus.

BACKGROUND

An image forming apparatus using an electrophotographic system performs an initial process (initializing process).

The initial process means a process of maintaining image quality in order to make image density appropriate, a process of checking the amount of toner or the amount of waste toner, or the like. When the image forming apparatus is a color machine, the initial process includes a registration process of registering positions of respective colors.

At the time of start-up, the image forming apparatus performs the initial process. Alternatively, after the image forming apparatus prints and outputs several thousand sheets, or after the image forming apparatus is left for a while, the image forming apparatus performs the initial process.

The image forming apparatus performs fixation heating. The fixation heating means raising the respective surface temperatures of a heat roller and a press roller in a fixing unit to printable fixing temperatures.

In the heating process, heat from a heat source is conducted to the heat roller and the press roller, and the temperature of the fixing unit is raised. A time required for the fixation heating is long. The time occupies a large ratio in the time required for the start-up process of the whole image forming apparatus. The power consumption by the fixing unit is largest in the image forming apparatus.

Hitherto, the image forming apparatus performs the initial process at the same time as the fixation heating. At the time of start-up, the image forming apparatus performs both the initial process and the fixation heating.

However, the total amount of power supplied from a commercial power source to the image forming apparatus is limited. The sum of the total amount of power required to perform the initial process and the total amount of power required for the fixation heating is limited.

When the initial process is performed, the image forming apparatus can not distribute a sufficient amount of power required for the fixation heating to the fixing unit. At the time of start-up operation, the image forming apparatus can not supply a sufficient amount of power to the fixing unit.

In order to raise the respective roller temperatures to specified temperatures by power of an amount distributed by a power source part, the image forming apparatus requires a longer heating time.

When the image forming apparatus requires the long time for heating the fixing unit, delay occurs in turning the state of the image forming apparatus from the state of the initial process to a printable state.

In the image forming apparatus, when the power source is turned on, or after several thousand sheets are printed and outputted, or at the time of resuming after the apparatus is left, delay occurs in the originally expected return time of the image forming apparatus.

DETAILED DESCRIPTION

Figure 1:
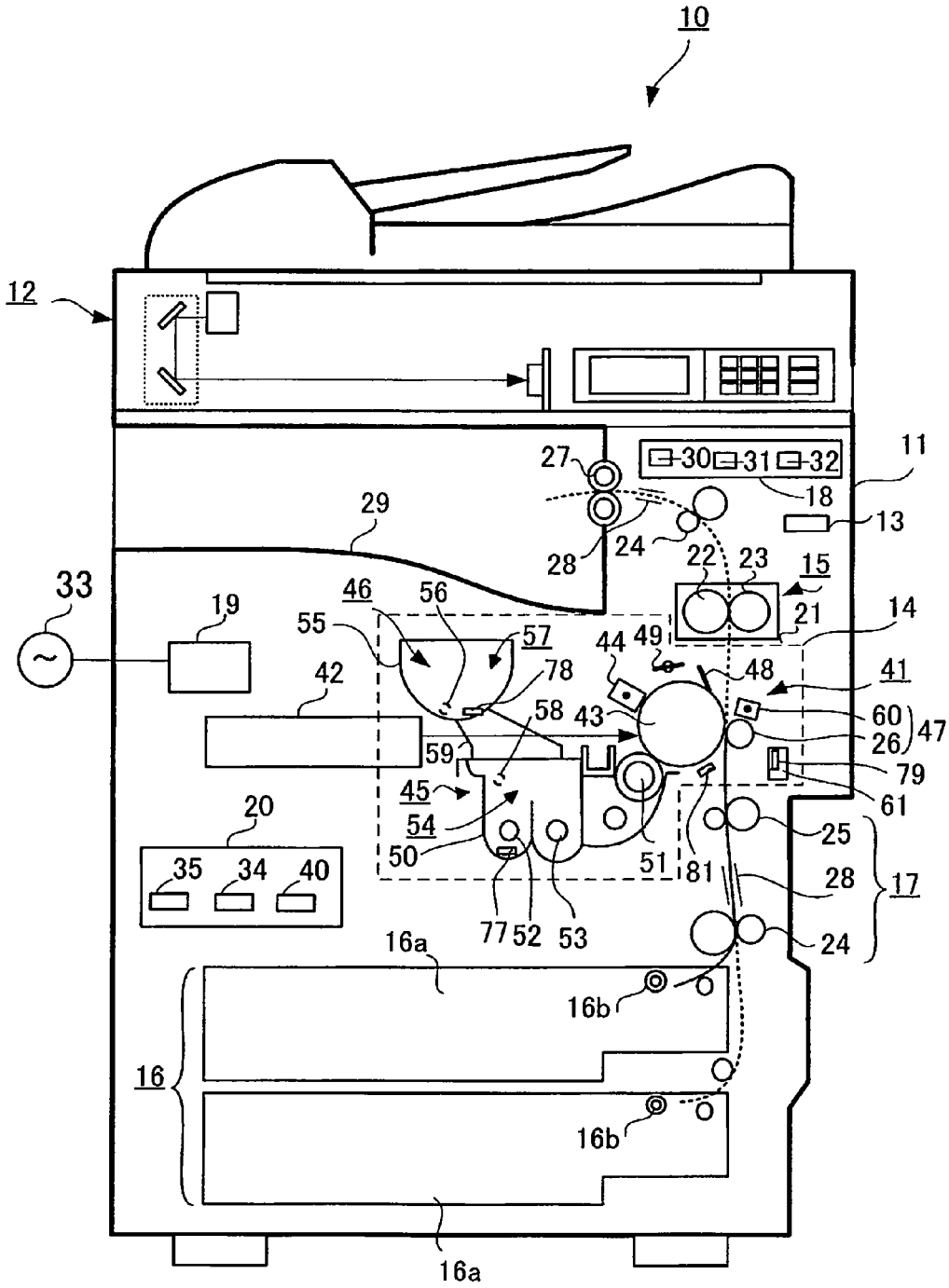
FIG. 1 is a structural view of an image forming apparatus according to a first embodiment.

Certain embodiments provide an image forming apparatus including: a print process part configured to form a not yet fixed developer image on a sheet; a heat roller configured to include a heating element, generate heat to the developer image on the sheet from the print process part and raise a first roller temperature by the heating element from a reference temperature to a first specified temperature; a press roller configured to press the sheet in cooperation with the heat roller, include a heater, and raise a second roller temperature by the heater from the reference temperature to a second specified temperature; a power source part configured to have a power upper limit value that is smaller than a sum of heating power required to heat the heat roller and the press roller plus initial power to adjust an image forming process condition and is larger than the heating power; a power source control part configured to control a distribution amount of the heating power to the heating element and the heater to prevent an amount of power supplied by the power source part from exceeding the power upper limit value and control supply or stop of the initial power; a plurality of temperature sensors configured to detect respective roller temperatures of the heat roller and the press roller; and a determination part configured to determine necessity of supplying the initial power by the power source control part based on a temperature difference between the respective roller temperatures detected by the respective temperature sensors.

Hereinafter, an image forming apparatus of an embodiment and a method of performing an initial process in the image forming apparatus will be described in detail with reference to the accompanying drawings.

Incidentally, the same portion in the respective drawings is denoted by the same reference numeral and its duplicate explanation is omitted.

First Embodiment

An image forming apparatus of a first embodiment is a monochrome printing MFP (Multi Function Peripheral) using an electrophotographic system.

A method of performing an initial process in the image forming apparatus of the first embodiment is a method of performing the initial process when the MFP is booted, or after a set number of sheets are printed and outputted, or after printing is performed after the MFP is left for a while.

FIG. 1 is a structural view of the MFP. The MFP 10 includes a main body 11, a scanner part 12, an image processing part 13, a print process part 14, a fixing unit 15, a paper feed part 16, a conveyance mechanism 17, a system control part 18, a power source part 19 and an electronic board 20.

The scanner part 12 optically scans a document surface. The scanner part 12 outputs image data from a read image signal. The image processing part 13 corrects the image data.

The print process part 14 forms a not yet fixed toner image (developer image) on a sheet and outputs the sheet.

The fixing unit 15 fixes the toner image onto the sheet by a heat roller 22 and a press roller 23 in a case 21.

The paper feed part 16 includes two-stage cassettes 16*a*. The paper feed part 16 supplies the sheet to the print process part 14 by a pair of pickup rollers 16*b*.

The conveyance mechanism 17 includes the heat roller 22, the press roller 23, plural pairs of conveyance rollers 24, a pair of registration rollers 25, plural pairs of transfer rollers 26 and a pair of paper discharge rollers 27.

The conveyance roller 24 sends a sheet to a conveyance path 28. The registration rollers 25 correct skew. The fixing unit 15 outputs the sheet after fixation. The paper discharge rollers 27 discharge the sheet to a tray 29.

The system control part 18 is a main controller to control the whole operation of the MFP 10. The system control part 18 controls scanning and image formation. The system control part 18 causes the conveyance mechanism 17 to convey the sheet.

The system control part 18 includes, on a main board 73, a CPU (Central Processing Unit) 30, a ROM (Read Only Memory) 31, a RAM (Random Access Memory) 32 and an LSI (Large Scale Integration).

The CPU 30 executes a program and causes the MFP 10 to perform the method of performing the initial process of the embodiment.

The ROM 31 stores the program. The ROM 31 stores a threshold of a temperature difference between the respective roller temperatures of the heat roller 22 and the press roller 23. The roller temperature means a surface temperature on the outer peripheral surface of a roller. The RAM 32 provides a work area for the CPU 30.

The power source part 19 generates, for example, four kinds of power source voltages from a commercial AC (Alternative Current) power source 33.

The four kinds of power source voltages include an AC voltage for an induction heating circuit 34 on the electronic board 20, an AC voltage for a halogen lamp driving circuit 35 on the electronic board 20, a high voltage DC (Direct Current) voltage for a charger for charging, development and transfer, and a low voltage DC voltage for the main board 73 and the electronic board 20.

The power source part 19 includes, as an example, a seesaw switch 36 (FIG. 3) to switch whether or not the power from the commercial AC power source 33 is fed to the MFP 10, and a relay circuit 37 to open or close a circuit by instructions from the system control part 18.

The seesaw switch 36 is a main switch for a user. The relay circuit 37 feeds the AC voltage to the induction heating circuit 34 and the halogen lamp driving circuit 35.

Further, the power source part 19 includes a high voltage power source part 38 to generate the high voltage DC voltage from the commercial AC power source 33 and a low voltage power source part 39 to generate the low voltage DC voltage.

The high voltage power source part 38 rectifies an AC voltage to a DC voltage, converts the DC voltage into a pulse-like AC voltage, smoothes the AC voltage to generate a DC voltage, and stabilizes a level of the DC voltage. The circuit of the low voltage power source part 39 is substantially the same as the circuit of the high voltage power source part 38.

The electronic board 20 mainly heats the fixing unit 15 and controls the temperature of the fixing unit 15. The electronic board 20 includes the induction heating circuit 34, the halogen lamp driving circuit 35, and a fixing control circuit 40.

The print process part 14 will be further described.

The print process part 14 includes an image forming part 41 and a laser exposure device 42. The image forming part 41 forms a toner image on a photoconductive drum 43 by the electrophotographic system. The laser exposure device 42 modulates a laser diode based on image data.

The image forming part 41 includes the photoconductive drum 43, a charging unit 44, a developing unit 45, a toner cartridge 46, a transfer unit 47, a cleaner 48 and a charge removal unit 49.

The photoconductive drum 43 carries a latent image thereon. The charging unit 44 charges the photoconductive drum 43. The laser exposure device 42 reduces the potential of a portion of the surface of the photoconductive drum 43. The portion is irradiated with a laser beam.

The developing unit 45 develops the latent image formed on the photoconductive drum 43. In the developing unit 45, a developer container 50 is filled with two-component developer. The developer mainly includes a toner and a magnetic carrier.

The developing unit 45 has a developing roller 51, and augers 52 and 53 in the developer container 50. The augers 52 and 53 send the developer to the developing roller 51. The developer container 50 includes a chamber 54.

The toner cartridge 46 includes a toner discharge port 56 in a cartridge container 55. The toner cartridge 46 stores supply toner in a chamber 57.

The chamber 57 of the toner cartridge 46 and the chamber 54 of the developing unit 45 communicate with each other through the discharge port 56 and a receiving port 58. Alternatively, the chambers 54 and 57 communicate with each other trough a toner conveyance path 59. The toner cartridge 46 supplies the toner to the developing unit 45.

The transfer unit 47 includes the transfer roller 26 to transfer a toner image on the photoconductive drum 43 onto a sheet, and a peeling device 60 to peel the sheet from the drum surface by applying a voltage to the sheet.

The cleaner 48 scrapes toner on the photoconductive drum 43. The waste toner is stored in a box 61. The charge removal unit 49 removes an electric charge on the surface of the photoconductive drum 43.

The print process part 14 delivers the sheet to the fixing unit 15.

Figure 2:
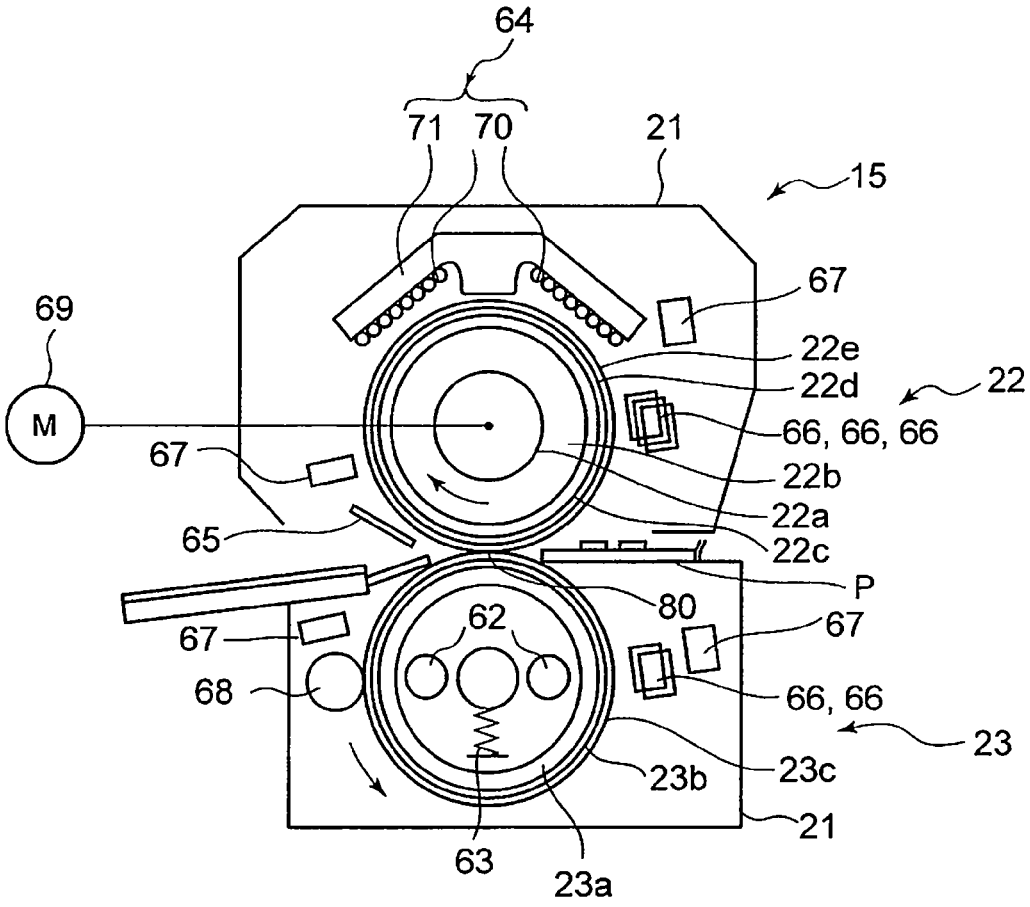
FIG. 2 is a view showing a vertical sectional structure of a fixing unit of the image forming apparatus according to the first embodiment.

FIG. 2 is a view showing a vertical sectional structure of the fixing unit 15. The drawing shows an example in which the front side is seen from the rear side of the main body 11. The same reference characters as already described ones denote the same components.

The fixing unit 15 includes the heat roller 22, the press roller 23, a halogen lamp 62 (heater), a spring 63, a coil unit 64, a blade 65, plural temperature sensors 66, plural protecting elements 67 and a cleaning roller 68.

The heat roller 22 is a fixing roller to fix a toner image on a sheet from the print process part 14. The heat roller 22 includes a heat generating layer 22*c* (heating element) to generate Joule heat.

The heat roller 22 includes a core metal 22*a*, a foamed rubber layer 22*b* around the core metal 22*a*, the heat generating layer 22*c*, a solid rubber layer 22*d* and a release layer 22*e*. The core metal 22*a* is rotated by a motor 69.

The heat generating layer 22*c* is a metal conductive layer having a resistance component. The heat generating layer 22*c* is made of nickel, stainless, aluminum, compound material of stainless and aluminum, or the like.

The heat roller 22 raises the roller temperature by the heat generating layer 22*c* from a reference temperature to a heat roller ready temperature (first specified temperature). The reference temperature means a room temperature. Alternatively, the reference temperature means an environmental temperature in the main body 11 at the room temperature.

The heat roller ready temperature means a temperature when the heat roller 22 is on stand-by. The heat roller ready temperature is determined by the fixing characteristic of toner. The value of the heat roller ready temperature is the value required to keep the heat lost by the conveyance of the sheet.

The heat roller 22 as a whole has a heat capacity (first heat capacity). The heat capacity is an index indicating the easiness of accumulating heat or difficulty of accumulating heat.

That the heat capacity is large or small indicates that the heat roller 22 and the press roller 23 are liable to be heated or cooled in relative meaning.

The core metal 22*a*, the foamed rubber layer 22*b*, the heat generating layer 22*c*, the solid rubber layer 22*d* and the release layer 22*e* are integrated.

The press roller 23, together with the heat roller 22, presses the sheet. The press roller 23 includes a cylindrical core metal 23*a*, a silicone rubber layer 23*b* around the core metal 23*a*, and a fluorine rubber layer 23*c*.

The press roller 23 is heated from the inside by, for example, the two halogen lamps 62. The halogen lamp 62 radiates heat by supply of an AC voltage or a DC voltage.

In the press roller 23, the halogen lamps 62 raise the roller temperature from a reference temperature to a press roller ready temperature (second specified temperature). The reference temperature means the room temperature or the environmental temperature at the room temperature.

The press roller ready temperature is also determined by the characteristic of the conveyance mechanism 17 or the fixing characteristic of the toner. The press roller 23 as a whole has a heat capacity (second heat capacity).

The heat capacity of the press roller 23 is larger than the heat capacity of the heat roller 22. The press roller 23 is harder to heat and to cool than the heat roller 22 by the same amount of power.

The spring 63 applies an elastic restoring force to the core metal 23*a* of the press roller 23. The case 21 holds the heat roller 22 and the press roller 23 so that the rotation shaft of the press roller 23 and the rotation shaft of the heat roller 22 are parallel to each other.

The heat roller 22 and the press roller 23 are rotated by gears and the like to transmit the motor drive force. The heat roller 22 rotates clockwise in the drawing. The press roller 23 rotates counterclockwise. The image on the sheet faces the heat roller 22.

The spring 63 causes the outer peripheral surface of the press roller 23 to contact the outer peripheral surface of the heat roller 22. The heat roller 22 and the press roller 23 form a nip 72 therebetween.

The coil unit 64 includes plural coils 70 and an insulative mold case 71 to support the respective coils 70. The respective coils 70 are induction heating coils.

The respective coils 70 are applied with high frequency current from the induction heating circuit 34, and generate magnetic flux. The magnetic flux passes through the heat generating layer 22*c* of the heat roller 22. The heat generating layer 22*c* generates an eddy current to prevent the change of a magnetic field. The resistive component of the heat generating layer 22*c* generates Joule heat by the eddy current. The heat roller 22 is heated.

As an example, the coil unit 64 includes the two coils 70 along the axial direction of the heat roller 22. The mold case 71 includes a magnetic core.

The blade surface of the blade 65 is positioned in the vicinity of the outer peripheral surface of the heat roller 22. The edge of the blade 65 is positioned downstream of the nip 72 in the sheet conveyance direction. The blade 65 peels the sheet moving in the nip state from the heat roller 22.

The five temperature sensors 66 detect the respective roller temperatures of the heat roller 22 and the press roller 23. Each of the temperature sensors 66 is a thermistor. The temperature sensors 66 input detection temperature information to the fixing control circuit 40.

The roller temperature of the heat roller 22 is the temperature at a position separate from the outer peripheral area of the heat roller 22. The roller temperature of the press roller 23 is the temperature at a position separate from the outer peripheral area of the press roller 23.

The respective temperature sensors 66 detect the respective roller temperatures of the heat roller 22 and the press roller 23. The system control part 18 distributes power to the heat roller 22 and the press roller 23, and heats the heat roller 22 and the press roller 23 by the distributed power. For example, the ROM 31 stores a distribution ratio.

The fixing control circuit 40 heats the heat roller 22 and the press roller 23 by constant heating powers, respectively.

The fixing control circuit 40 or the system control part 18 determines heating times so that the press roller ready temperature becomes lower than the heat roller ready temperature. The system control part 18 previously determines the time lengths of the respective heating times based on the respective heat capacities.

A first heating time is required to raise the roller temperature of the heat roller 22 from the reference temperature to the heat roller ready temperature. A second heating time is required to raise the roller temperature of the press roller 23 from the reference temperature to the press roller ready temperature.

The respective heating times are determined by the respective heat capacities and the respective heating powers. The fixing control circuit 40 controls heating so that the second heating time becomes longer than the first heating time.

The heat roller 22 includes, as an example, the three temperature sensors 66 arranged in the roller shaft direction. The press roller 23 includes the two temperature sensors 66 arranged in the roller shaft direction.

Each of the protecting elements 67 is a non-contact thermostat. The thermostat detects an excessive current. One of the protecting elements 67 opens the circuit by the excessive current due to the abnormal temperature rise of the heat roller 22. The other protecting element 67 opens the circuit by the excessive current due to the abnormal temperature rise of the press roller 23.

The cleaning roller 68 removes the toner attached to the outer peripheral surface of the press roller 23.

Figure 3:
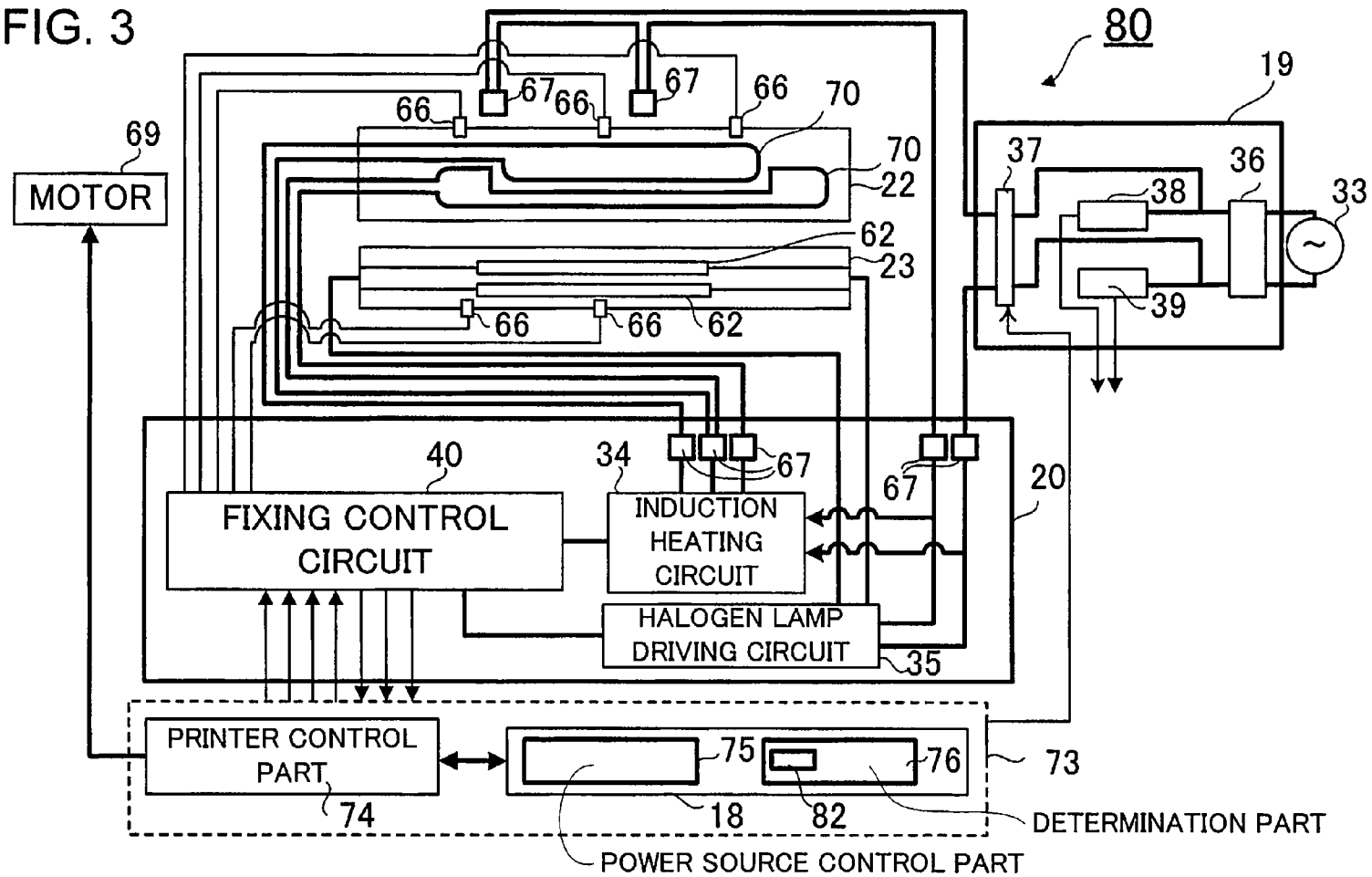
FIG. 3 is a structural view of a control system that mainly conducts control of the fixing unit of the image forming apparatus according to the first embodiment.

FIG. 3 is a structural view of a control system that mainly conducts control of the fixing unit 15. The same reference characters as already described ones denote the same components.

The power source part 19 supplies power lower than a power upper limit value. The power upper limit is smaller than the sum of heating power and initial power. The power upper limit is larger than the heating power. The heating power means the sum of power required to heat the heat roller 22 plus power required to heat the press roller 23. The initial power means power required to perform the initial process for adjusting an image forming process condition to a printable condition.

The control system 80 includes the system control part 18 and a printer control part 74 on the main board 73.

The system control part 18 includes a power source control part 75 and a determination part 76.

The power source control part 75 controls the distribution amount of the heating power to the heat generating layer 22*c* and the halogen lamp 62 so that the amount of power supplied by the power source part 19 does not exceed the power upper limit. The power source control part 75 controls the supply or stop of the initial power.

The determination part 76 determines the necessity of supplying the initial power from the power source part 19 by the power source control part 75. The initial power is the power during execution of the initial operation by the MFP 10. The print process part 14, the scanner part 12, the paper feed part 16 and the conveyance mechanism 17 use the initial power.

The determination part 76 determines the necessity of the initial process based on the temperature difference between the roller temperature of the heat roller 22 and the roller temperature of the press roller 23 detected by the respective temperature sensors 66.

When the temperature difference is smaller than the threshold, the determination part 76 causes the power source control part 75 to start the supply of the initial power after the roller temperature of the heat roller 22 reaches the heat roller ready temperature.

When the temperature difference is larger than the threshold, the determination part 76 prevents the power source control part 75 from supplying the initial power.

The functions of the power source control part 75 and the determination part 76 are executed by the CPU 30, the ROM 31 and the RAM 32.

The power source control part 75 causes the fixing control circuit 40 to distribute the heating power through the printer control part 74. Alternatively, the power source control part 75 directly reads the distribution ratio from the ROM 31, and sets the distribution ratio in the fixing control circuit 40.

The printer control part 74 controls the print process part 14, the paper feed part 16 and the motor 69. The printer control part 74 receives user instruction information and operation mode information from the system control part 18. The printer control part 74 notifies the system control part 18 of the number of prints performed by the print process part 14.

Further, the control system 80 includes the induction heating circuit 34 on the electronic board 20.

The induction heating circuit 34 is an inverter drive circuit to supply drive power to the three coils 70. The induction heating circuit 34 converts the AC voltage supplied from the power source part 19 into high frequency current. The induction heating circuit 34 applies the high frequency current to the coil unit 64.

The halogen lamp driving circuit 35 supplies power to the halogen lamp 62.

The control system 80 includes plural protecting elements 67 to connect the induction heating circuit 34 and the power source part 19 in series. Similarly, the control system 80 includes plural protecting elements 67 to connect the halogen lamp driving circuit 35 and the power source part 19 in series.

The protecting elements 67 at the induction heating circuit 34 side forcibly cut off the power supply to the induction heating circuit 34 and the current application to the coil 70 by excess current.

The cut-off of power supply to the halogen lamp driving circuit 35 and the halogen lamp 62 by the protecting elements 67 is the same as the example of the induction heating circuit 34.

The induction heating circuit 34 and the halogen lamp driving circuit 35 are supplied with AC voltage from the power source part 19 through the relay circuit 37. The electronic board 20 is supplied with the fixation heating power of the entire power from the commercial AC power source 33.

The fixing control circuit 40 distributes the fixation heating power to the heat roller 22 and the press roller 23. The fixing control circuit 40 drives the temperature rise of the heat roller 22 and the press roller 23. The fixing control circuit 40 uses, for example, an MPU (Micro Processing Unit).

The fixing control circuit 40 sets a target temperature of the heat roller 22 received from the system control part 18 into the induction heating circuit 34. The fixing control circuit 40 sets a target temperature of the press roller 23 received from the system control part 18 into the halogen lamp driving circuit 35.

The fixing control circuit 40 collects the roller temperature of the heat roller 22 and the roller temperature of the press roller 23 from the plural temperature sensors 66 in the fixing unit 15. The fixing control circuit 40 notifies the system control part 18 and the printer control part 74 of roller temperature information of the heat roller 22 and the press roller 23.

Further, the control system 80 includes various detection devices. The developing unit 45 (FIG. 1) includes a toner sensor 77 to detect toner density in the developing container 50. The toner cartridge 46 includes another toner sensor 78 to detect toner density in the cartridge container 55.

The box 61 includes a near full sensor 79. The print process part 14 includes a photosensor 81 near the photoconductive drum 43. The photosensor 81 is a sensor to optically detect the amount of toner attached on the photoconductive drum 43.

The system control part 18 detects toner empty in the developing unit 45 by the toner sensor 77. The system control part 18 detects by the toner sensor 78 that the toner in the toner cartridge 46 soon becomes empty. The system control part 18 detects the necessity of discarding the waste toner by the near full sensor 79.

The method of performing the initial process in the MFP 10 will be described. Immediately after the MFP 10 is booted, the MFP 10 performs the method.

In the method, the temperature sensors 66 detect the respective roller temperatures of the heat roller 22 and the press roller 23 to which the heating powers are supplied from the power source part 19. The determination part 76 determines whether the initial operation is required or not. The determination part 76 determines necessity from the temperature difference between the detection temperature of the heat roller 22 and the detection temperature of the press roller 23. The determination part 76 determines the necessity of supplying the initial power. When the determination result of the determination part 76 indicates that the supply is required, the supply of the initial power starts after the roller temperature of the heat roller 22 reaches a predetermined specified temperature.

The power source is applied to the MFP 10 having the foregoing structure. The system control part 18 changes the mode of the MFP 10 to, for example, a warming-up mode.

In the warming-up mode, the system control part 18 sets the target value of the fixation heating temperature as follows: the surface temperature of the heat roller 22 is 160° C.; and the surface temperature of the press roller 23 is 130° C.

In the warming-up mode, an operation when the system control part 18 performs the initial process will be described with reference to FIGS. 4 to 5.

Figure 4:
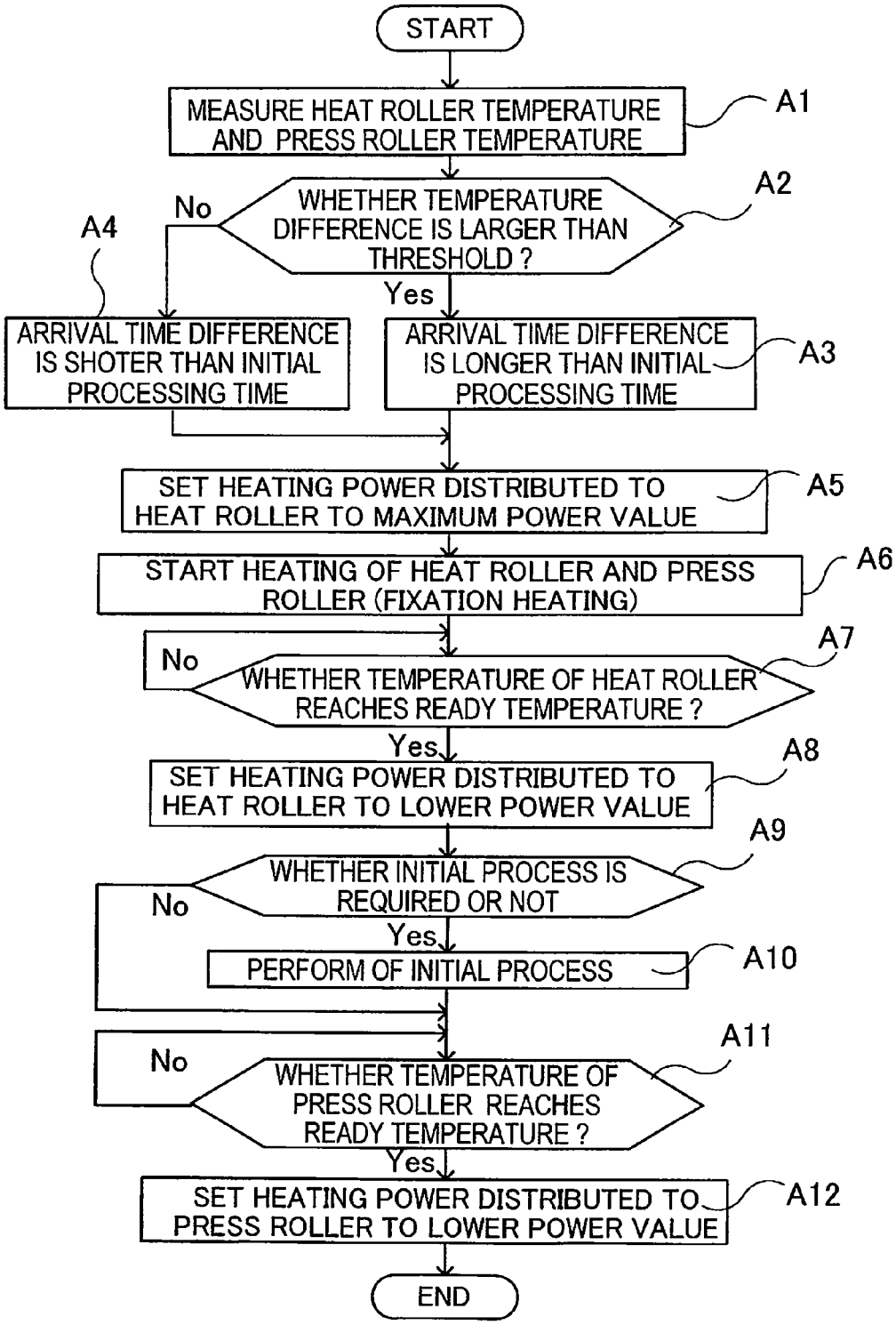
FIG. 4 is a flowchart for explaining a determination process in a method of performing an initial process in the image forming apparatus according to the first embodiment.

FIG. 4 is a flowchart for explaining a process of determining the necessity of performing the initial process by MFP 10.

Figures 5A, 5B:
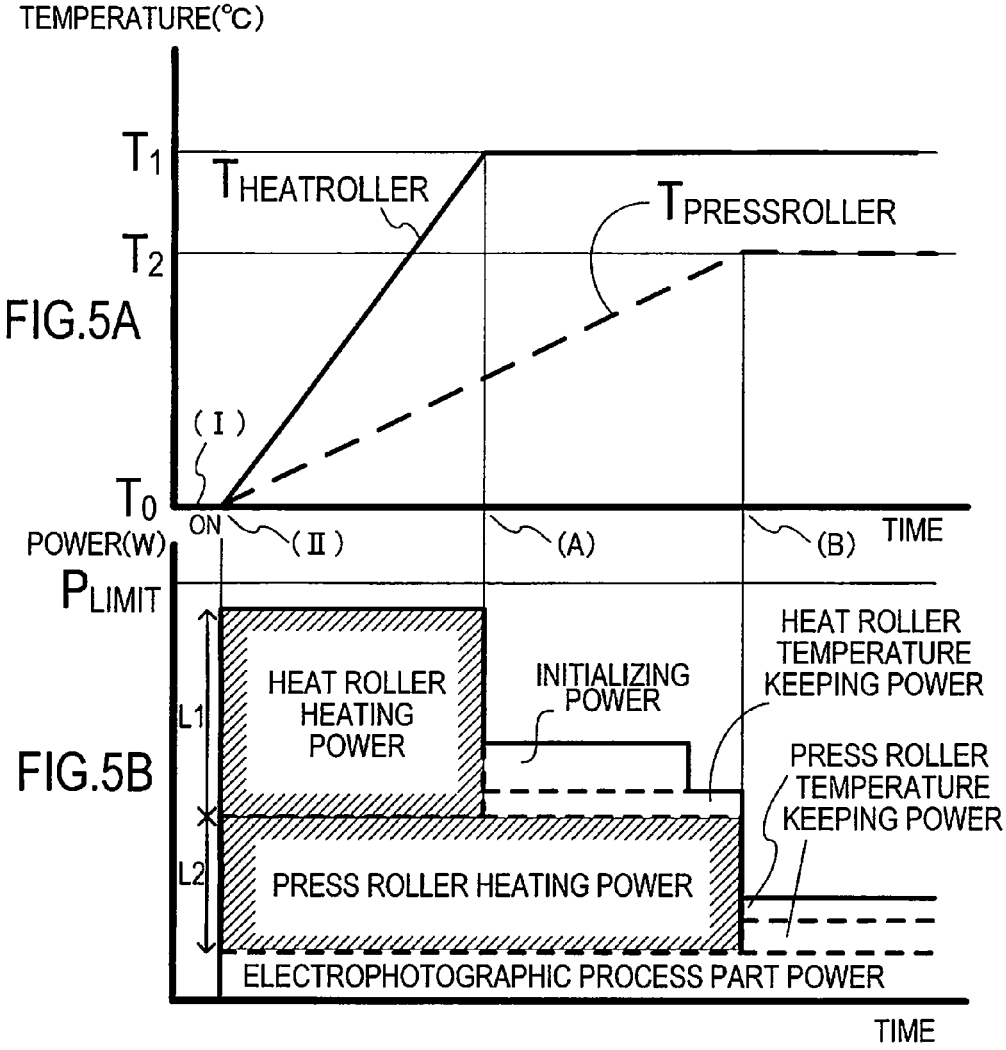
FIG. 5A is a view showing temperature rise characteristics of a heat roller and a press roller in the image forming apparatus according to the first embodiment in which an initial process is performed.
FIG. 5B is a view showing temporal change of power consumption distributed to heating of the heat roller, heating of the press roller and the initial process in the image forming apparatus according to the first embodiment in which the initial process is performed.

FIG. 5A is a view showing temperature rise characteristics of the heat roller 22 and the press roller 23 in the MFP 10 in which the initial process is performed.

FIG. 5B is a view showing temporal change of power consumption distributed to heating of the heat roller 22, heating of the press roller 23 and the initial process, in which the initial process is performed. FIGS. 5A and 5B have the same temporal scale in common.

$T_0$ denotes the reference temperature. $T_1$ denotes the heat roller ready temperature. $T_2$ denotes the press roller ready temperature. $T_{HEATROLLER}$ denotes the rise characteristic of the roller temperature of the heat roller 22. $T_{PRESSROLLER}$ denotes the rise characteristic of the roller temperature of the press roller 23. $P_{LIMIT}$ denotes the power upper limit value.

Time point (I) of FIG. 5A denotes the detection time point of the respective roller temperatures by the system control part 18. A time length between time point (II) and time point (A) represents a first heating time. A time length between time point (II) and time point (B) represents a second heating time.

At Act A1 of FIG. 4, the system control part 18 collects the respective roller temperatures of the heat roller 22 and the press roller 23 at time point (I).

At Act A2, the system control part 18 compares the temperature difference between the respective roller temperatures with a threshold. When the temperature difference is larger than the threshold, the system control part 18 passes through the Yes route, and at Act A3, the system control part 18 estimates that an arrival time difference is longer than a processing time required to execute the initial process.

The arrival time difference means a difference between time points when the respective roller temperatures of the heat roller 22 and the press roller 23 reach the ready temperatures. The arrival temperature difference is the time difference between time points (A) and (B) in FIGS. 5A and 5B.

The determination part 76 estimates the first heating time according to the heat generation amount of the heat generating layer 22*c* and the heat capacity of the heat roller 22. The determination part 76 estimates the second heating time according to the heat generation amount and the heat capacity of the press roller 23. By the difference between the heating times, the determination part 76 estimates the arrival time difference.

When the arrival time difference is longer than the processing time, the determination part 76 causes the power source control part 75 to start the supply of the initial power in a period from an end of the first heating time to an end of the second heating time.

The power source control part 76 performs power control in the period. The power source control part 76 calculates a sum of: the initial power; temperature keeping power to keep the roller temperature of the heat roller 22; the heating power distributed to the press roller 23; and print process power supplied to the print process part 24. The power source control part 76 causes the sum to be smaller than the power upper limit value.

The system control part 18 writes a value indicating that the execution of the initial process is necessary into, for example, a storage area 82.

Continuously, at Act A5, the system control part 18 sets the heating power to the heat roller 22 and the press roller 23 to full power. That is, the system control part 18 distributes the supply power from the power source part 19 to the heating power for the heat roller 22 and the heating power for the press roller 23 at the maximum values.

At Act A6, the system control part 18 starts fixation heating to the target value of the fixation heating temperature. The system control part 18 starts to heat the heat roller 22 and the press roller 23.

As shown in FIGS. 5A and 5B, the temperature of the heat roller 22 starts to rise from time point (II). Time point (II) represents a heating start time point. The temperature of the press roller 23 also starts to rise from time point (II).

From time point (II), the system control part 18 supplies power to another electrophotographic process part other than the fixing unit 15 in the MFP 10. The another electrophotographic process part means substantially the print process part 14.

The roller temperature of the heat roller 22 and the roller temperature of the press roller 23 respectively start to rise from the reference temperature $T_0$.

Act A6 is a heating process. At Act A7, the system control part 18 uses the output of the temperature sensor 66 and monitors whether the roller temperature of the heat roller 22 reaches the heat roller ready temperature (No route of Act A7).

At Act A7, when detecting that the heat roller 22 reaches the heat roller ready temperature, the system control part 18 passes through the Yes route, and at Act A8, the system control part 18 sets the heating power to the heat roller 22 to a lower value of heat roller temperature keeping power.

After time point (A), the system control part 18 starts to keep the roller temperature of the heat roller 22. The press roller 23 is yet in the middle of the heating process.

At Act A9, the system control part 18 reads the value of the storage area 82, and determines the necessity of the initial process.

When the value indicates that the initial process is required, the system control part 18 passes through the Yes route and performs the initial process.

As shown in FIG. 5B, the system control part 18 starts to feed the initializing power to necessary portions in the MFP 10. The system control part 18 starts the initial process.

Specifically, the system control part 18 causes the toner sensor 77 to check whether the toner amount of the developing unit 45 is sufficient. The system control part 18 causes the toner sensor 78 to check whether the toner amount of the toner cartridge 46 is sufficient.

The system control part 18 causes the near full sensor 79 to check whether the toner box 61 is not filled with toner.

The system control part 18 causes the print process part 14 to generate a patch pattern on the photoconductive drum 43. The system control part 18 uses the photosensor 81 to measure the toner density.

Based on the detected density, the system control part 18 corrects the density of the toner image developed by the developing unit 45. Based on the detected density, the system control part 18 causes the print process part 14 to adjust the toner amount. The image quality is kept.

The system control part 18 terminates the initial process before time point (B). That is, the MFP 10 does not perform the initial process and the heating process of the fixing unit 15 at the same time. The MFP 10 performs the initial process after the fixation heating.

During the initial operation, the power consumption of the MFP 10 includes the initializing power, the heat roller temperature keeping power, the press roller heating power, and the apparatus power of the MFP. The total amount of power is smaller than the power upper limit.

At Act A11, the system control part 18 monitors whether the roller temperature of the press roller 23 reaches the press roller ready temperature (No route of Act A11).

At Act A11, the system control part 18 detects that the press roller 23 reaches the press roller ready temperature. The system control part 18 passes through the Yes route, and sets, at Act A12, the heating power for the press roller 23 to a lower value of press roller temperature keeping power.

The system control part 18 starts to keep the respective roller temperatures of the heat roller 22 and the press roller 23.

As shown in FIG. 5B, the MFP 10 does not perform the initial process in the period from time point (II) to time point (A). The MFP 10 performs the initial process in the period from time point (A) to time point (B).

It is assumed that the initial process is performed in the period from time point (II) to time point (A). The required total amount of power includes the apparatus power, the press roller heating power, the heat roller heating power and the initializing power. The total amount of power exceeds the power upper limit.

The MFP 10 shifts the initial process to the time period from time point (A) to time point (B). In the time period, the total amount of power includes the apparatus power, the press roller heating power, the heat roller temperature keeping power and the initializing power. The total amount of power does not exceed the power upper limit.

Next, a description will be made on an example in which after the power source is turned off, the power source is turned on before the temperature of the fixing unit 15 does not become cool. The operation of the MFP 10 when the initial process is not performed will be described with reference to FIGS. 4, 6A and 6B.

Figures 6A, 6B:
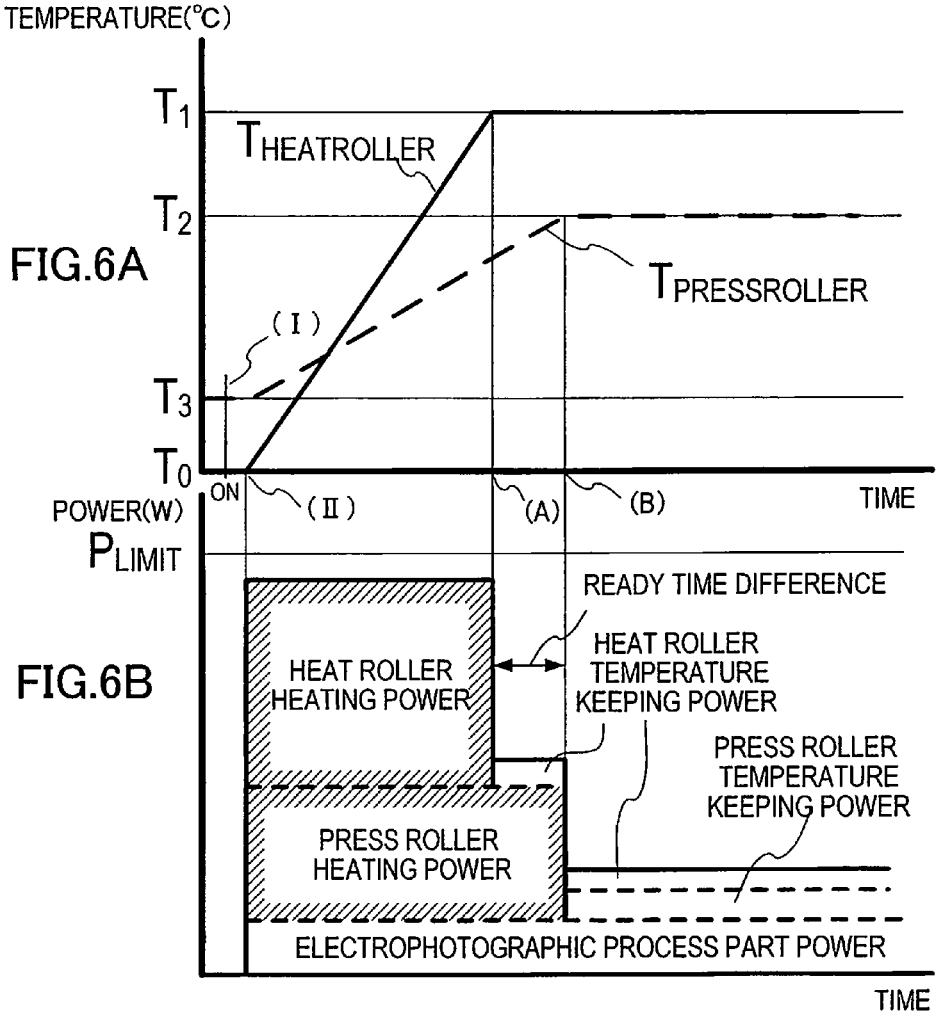
FIG. 6A is a view showing temperature rise characteristics of the heat roller and the press roller in the image forming apparatus according to the first embodiment in which the initial process is not performed.
FIG. 6B is a view showing temporal change of power consumption distributed to heating of the heat roller, heating of the press roller and the initial process in the image forming apparatus according to the first embodiment in which the initial process is not performed.

FIG. 6A is a view showing temperature rise characteristics of the heat roller 22 and the press roller in the MFP 10 in which the initial process is not performed. FIG. 6B is a view showing temporal change of power consumption distributed to heating of the heat roller 22, heating of the press roller 23 and the initial process, in which the initial process is not performed.

In FIGS. 6A and 6B, the same reference characters as already described ones denote the same components. FIGS. 6A and 6B have the same time scale in common.

At time point (I) of FIG. 6A, the system control part 18 collects the respective roller temperatures of the heat roller 22 and the press roller 23 (Act A1 of FIG. 4).

The system control part 18 compares a temperature difference with a threshold and estimates whether an arrival time difference is longer or shorter than a time required to perform the initial process (Act A2).

When the system control part 18 determines the necessity of the initial process after the end of printing, for example, after several ten minutes, the fixing unit 15 is not completely cooled.

Since the heat roller 22 has a small heat capacity, the roller temperature of the heat roller 22 is reference temperature $T_0$. Since the press roller 23 has a large heat capacity, the press roller 23 holds residual heat. The roller temperature of the press roller 23 is residual heat temperature $T_3$.

At Act A2, the system control part 18 determines that the temperature difference is larger than the threshold. The system control part 18 passes through the No route, and determines at Act A4 that the initial process is not performed. A value indicating that the initial process is not performed is written in the storage area 82.

Continuously, the system control part 18 sets the heating power distributed to the heat roller 22 to the maximum power value which can be supplied to the heat roller 22 (Act A5). The system control part 18 starts to heat the heat roller 22 and the press roller 23 (Act A6).

As shown in FIGS. 6A and 6B, at time point (II), the temperature of the heat roller 22 starts to rise from the reference temperature $T_0$. The temperature of the press roller 23 starts to rise from the residual heat temperature $T_3$.

The system control part 18 determines whether the roller temperature of the heat roller 22 reaches the heat roller ready temperature (No route of Act A7).

At Act A7, when detecting the arrival of the temperature, the system control part 18 passes through the Yes route, and sets the heating power for the heat roller 22 to a lower value of heat roller temperature keeping power (Act A8).

After time point (A), at Act A9, the system control part 18 reads the value which indicates unnecessity of the initial process from the storage area 82, and passes through the No route. The system control part 18 does not perform the initial process.

The system control part 18 monitors whether the roller temperature of the press roller 23 reaches the press roller ready temperature (No route at Act A11).

The time reaches time point (B) of FIG. 6B (Act A11). When detecting that the temperature of the press roller 23 reaches the press roller ready temperature, the system control part 18 passes through the Yes route, and sets the heating power for the press roller 23 to a lower value of press roller temperature keeping power (Act A12).

The system control part 18 starts to keep the respective roller temperatures of the heat roller 22 and the press roller 23.

The above is the example when the power source is turned on and the necessity is determined at the time of start-up.

After the power source is turned on, the MFP 10 terminates the warming-up. The system control part 18 transitions the mode of the MFP 10 to a ready mode or a standby mode.

When the MFP 10 receives a print job, the system control part 18 transitions the mode of the MFP 10 to a copy mode.

For example, in the copy mode, the system control part 18 sets the fixation heating temperature to the following value: the surface temperature of the heat roller 22 is 160±10° C.; and the surface temperature of the press roller 23 is 130±15° C.

In the MFP 10, a document is inserted in from the scanner part 12. The MFP 10 picks up a sheet from the paper feed part 16, and performs an image forming process by the print process part 14.

The fixing unit 15 fixes a toner image on the sheet. The MFP 10 performs printout. The printer control part 74 counts up the total number of prints.

When printing is ended, the system control part 18 lowers the surface temperature of the heat roller 22 and the surface temperature of the press roller 23.

The system control part 18 reads the print number counter from the RAM 32. It is assumed that the threshold is, for example, several thousand.

At the timing when the number of prints exceeds the threshold, the system control part 18 determines the necessity of the initial process substantially in the same way as the example of FIG. 4. When the temperature difference is smaller than the threshold, the system control part 18 shifts the start timing of the initial process to a time after the heating process of the heat roller 22 and the press roller 23 is completed.

After printing out, the MFP 10 is left for a while. The MFP 10 does not generate a print job for several hours or more.

At the timing when the system control part detects that the MFP 10 is left, the system control part 18 determines the necessity of the initial process substantially in the same way as the example of FIG. 4. When the temperature difference is smaller than the threshold, the system control part 18 performs the initial process.

To sum up, in the example of FIGS. 6A and 6B, the determination part 76 estimates whether the arrival time difference from time point (A) to time point (B) is longer than the processing time required to perform the initial process. Based on the estimation, the system control part 18 determines to omit the initial process in advance.

When the arrival time difference is shorter than the processing time, the determination part 76 prevents the power source control part 77 from supplying the initial power.

FIGS. 7A to 8B show simple graphs of temperature rise characteristics of a fixing part in an image forming apparatus of the related art and power consumption in a heating process.

Figures 7A, 7B:
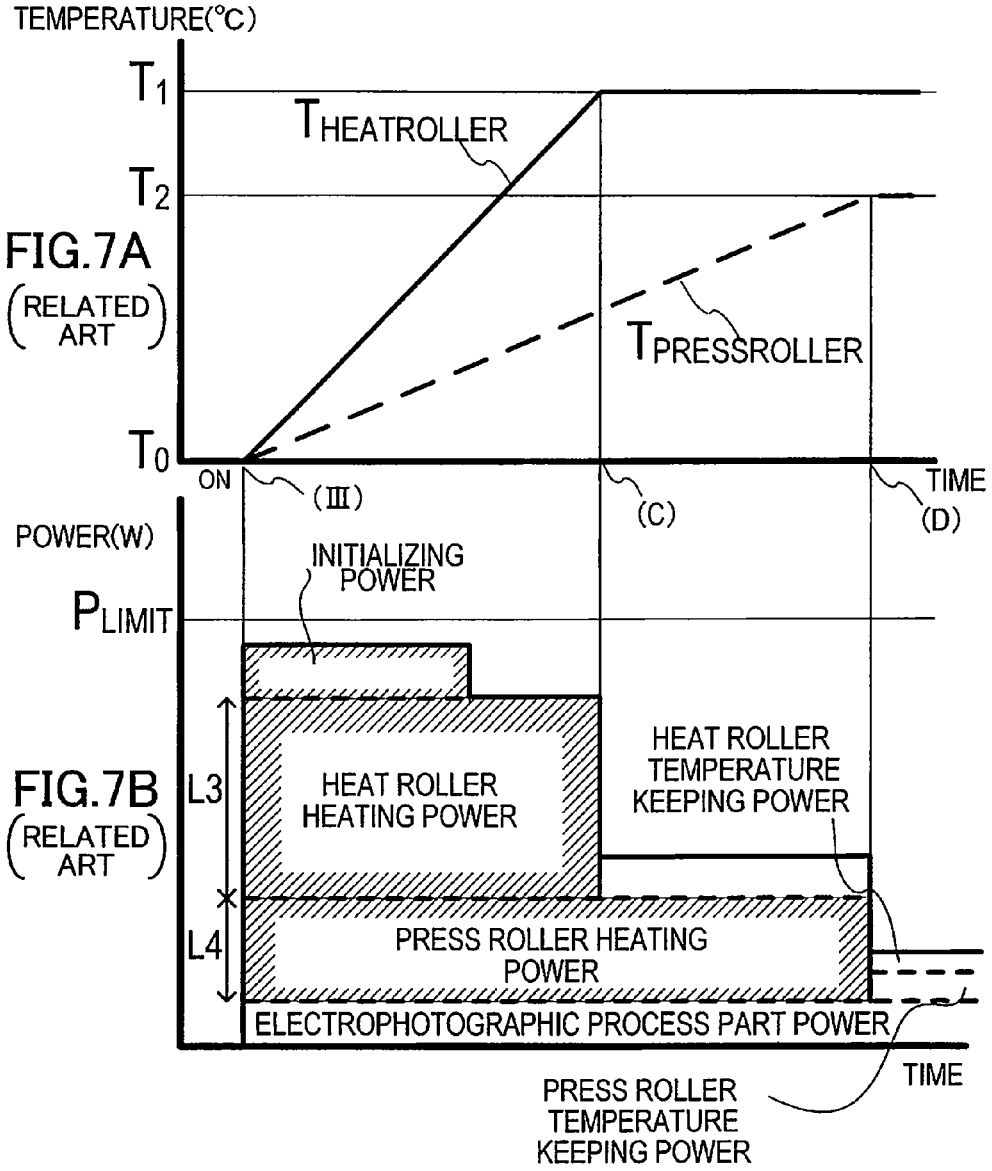
FIG.7A (RELATED ART)
FIG.7B (RELATED ART)
FIG. 7A is a view showing a temperature rise characteristic of a fixing unit when a power source is turned on after the temperature of the fixing unit of an image forming apparatus according to related art is sufficiently cooled.
FIG. 7B is a view showing temporal change of power consumption of the fixing unit after the power source is turned on after the temperature of the fixing unit of the image forming apparatus according to the related art is sufficiently cooled.

FIG. 7A is a view showing the temperature rise characteristics of the fixing unit when the power source is turned on after the temperature of the fixing unit is sufficiently cooled in the image forming apparatus according to the related art. FIG. 7B is a view sowing the temporal change of power consumption of the fixing unit after the power source is turned on after the temperature of the fixing unit is sufficiently cooled in the image forming apparatus according to the related art.

Time point (III) indicates power-on. Time point (C) indicates that the heat roller reaches the heat roller ready temperature. Time point (D) indicates that the press roller reaches the press roller ready temperature. The same reference characters as already described ones other than those denotes the same or equivalent components.

In FIGS. 7A and 7B, a period from time point (III) to time point (C) indicates a heating process. FIGS. 7A to 8B are different from FIGS. 5A to 6B in that the image forming apparatus performs the initial process in the heating process.

Immediately after the power source is turned on, the roller temperature of the heat roller and the roller temperature of the press roller are almost equal to each other. The image forming apparatus starts to feed the heating power immediately after power-on. The temperatures of both the heat roller and the press roller start to rise.

The heat capacity of the press roller is larger than the heat capacity of the heat roller. The temperature of the press roller is hard to rise. The time required for the roller temperature of the press roller to reach the printable ready temperature is longer than time of the heat roller.

At time point (C), also after the temperature of the heat roller reaches the printable temperature, the press roller is continuously kept to be fed with the heating power. The heat roller enters a temperature keeping state. The temperature keeping state continues till time point (D) when the press roller reaches the printable temperature.

During the period from time point (III) to time point (C), the respective heating powers for the heat roller and the press roller are not the maximum feedable power. For example, in FIGS. 5B and 7B, power amounts L3 and L4 are smaller than power amounts L1 and L2, respectively. The MFP 10 can heat the fixing unit 15 at the maximum power amounts L1 and L2.

A loss occurs in the power consumption during the execution time of the warm-up process, and the temperature keeping control of the heat roller runs a state where power is wastefully consumed.

The image forming apparatus of the related art performs the initial process, such as an image quality keeping process for making image density appropriate, in addition to the fixation heating. In a color machine, an alignment process to align test image pattern positions of respective colors is also performed. The power for the initial process is also consumed.

In general, the commercial power source has a rated capacity. In Japan and the United States, a power code connected to an outlet tap has a rated capacity of 1500 W at maximum. The power source capacity and the capacity of the power code have limited values. The power exceeding the limited value can not be supplied.

In the image forming apparatus of the related art, the sum of the fixation heating power, the initial power, and the other apparatus power is required not to exceed the power upper limit which can be supplied from the power source part 19. The fixation heating power is the power obtained by combining the heating power for the single heat roller and the heating power for the single press roller.

The image forming apparatus is required to heat the heat roller and the press roller by the power obtained by subtracting the power required for the initial process from the fixation heating power.

Figures 8A, 8B:
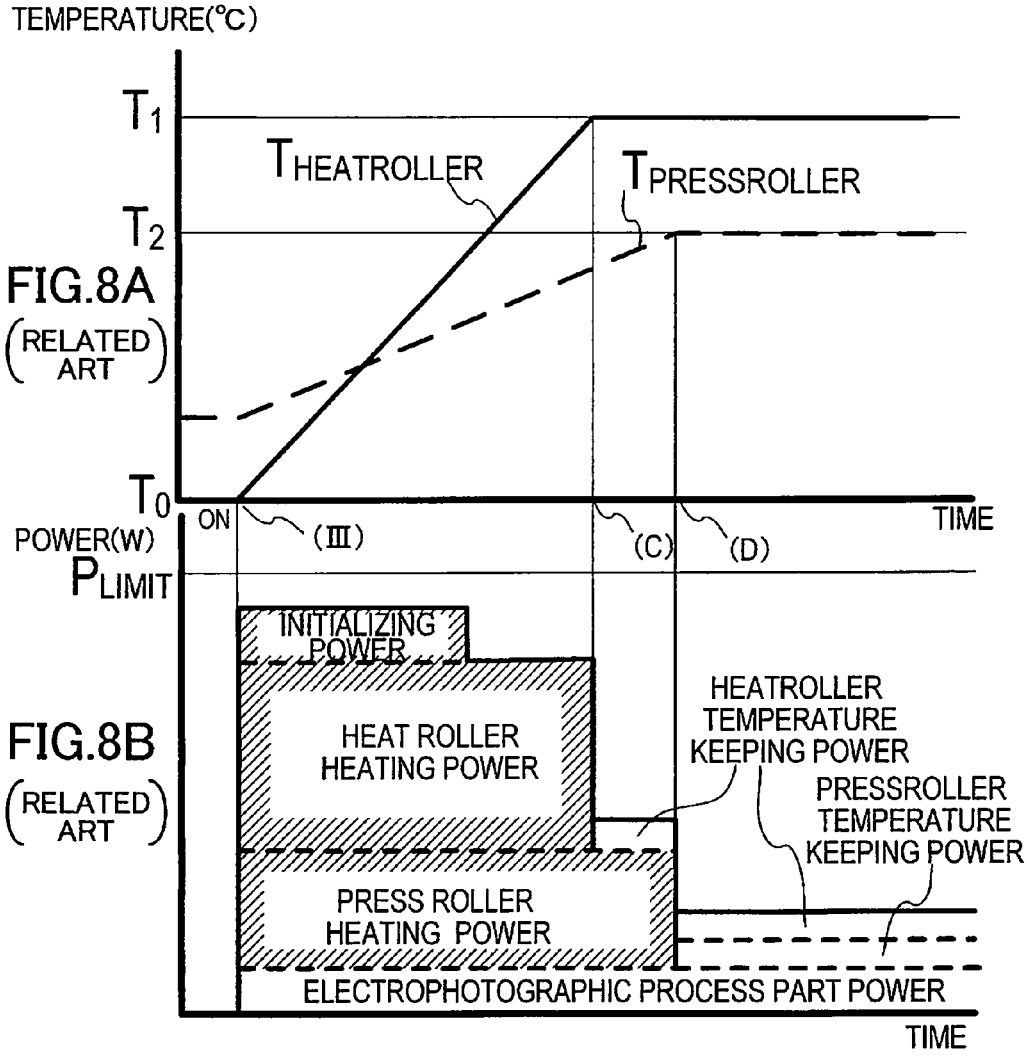
FIG.8A (RELATED ART)
FIG.8B (RELATED ART)
FIG. 8A is a view showing a temperature rise characteristic of the fixing unit after the power source is turned on before the temperature of the fixing unit of the image forming apparatus according to the related art is cooled.
FIG. 8B is a view showing temporal change of power consumption of the fixing unit after the power source is turned on before the temperature of the fixing unit of the image forming apparatus according to the related art is cooled.

FIGS. 8A and 8B show simple graphs in the case when the image forming apparatus of the related art is turned on while the fixing unit holds residual heat temperature.

FIG. 8A is a view showing the temperature rise characteristics of the fixing unit after the power source is turned on before the fixing unit temperature is not cooled in the image forming apparatus according to the related art. The drawing shows the temperatures of the heat roller and the press roller when the power source is again turned on soon after the power source is turned off.

FIG. 8B is a view showing temporal change of the power consumption of the fixing unit of the image forming apparatus according to the related art corresponding to FIG. 8A. The same reference characters as already described ones denote the same or equivalent components.

The heat capacity of the press roller is large. Differently from FIG. 7B, in FIG. 8B, immediately after the power source is turned on at time point (III), the press roller already stores the heat applied to the press roller at a stage earlier than time point (III).

The temperature of the press roller immediately after power-on is higher than the temperature of the heat roller.

From time point (III), the image forming apparatus starts to feed the heating power to the heat roller and the press roller.

Although the roller temperature of the press roller rises, as compared with the arrival time point (D) in the state of FIG. 7A, the arrival time point (D) in FIG. 8A is earlier.

In FIG. 8A, an arrival time difference between the arrival time point (D) and the arrival time point (C) when the heat roller reaches the printable temperature is smaller than that in FIG. 7A. Even in this state, there is a case where the image forming apparatus of the related art performs the initial process.

When the image forming apparatus performs the initial process, similarly to the example of FIG. 7B, the image forming apparatus is required to heat the heat roller and the press roller by power obtained by subtracting power required to perform the initial process from fixation heating power.

The above is the description on the image forming apparatus of the related art.

In the example of the graphs of FIGS. 5A to 5B, when the power source is turned on at time point (I), in the MFP 10, a sufficient time elapses after the power source was turned OFF at the previous time or finish of the power feed for fixation heating.

In this case, as in FIGS. 5A and 5B, the temperature of the heat roller 22 and the temperature of the press roller 23 are almost equal to the ambient temperature. The heat roller 22 and the press roller 23 have almost the same roller temperature.

In the MFP 10, the sufficient time elapses until the source was turned ON after the power source was turned OFF at the previous time or finish of the power feed for the fixation heating.

There is a high possibility that the image forming process condition at time point (I) is changed from the image forming process condition at the previous print time. Since that, the MFP 10 is necessary to perform the initial process.

In this embodiment, the MFP 10 does not perform the initial process accompanied by the operation of the electrophotographic process part at the time of start of heating.

That is, immediately after the power source is turned ON at time point (I), the power which was used for initialization of the related art can also be fed to the fixing roller. When an arbitrary time passes, the heat roller 22 having the low heat capacity and requiring larger heating feed power reaches the printable temperature. The system control part 18 starts to perform temperature keeping control of the heat roller 22.

At this time point, the system control part 18 starts the initial operation, and completes the initial operation before the temperature of the other press roller 23 reaches the printable temperature.

The determination of the determination part 76 as to whether or not the initial operation is performed is the determination based on the temperature difference between the heat roller 22 and the press roller 23 at the time of power-ON.

Based on the difference of the temperature, the system control part 18 estimates the difference between times when the heat roller 22 and the press roller 23 reach the fixable temperatures. When the difference is smaller than the initial operation time, the system control part 18 does not perform the initial operation. When the time difference is larger than the initial operation time, the system control part 18 performs the initial operation.

In this way, since the MFP 10 does not perform the unnecessary initial operation, the rise time can be shortened.

Even if the MFP 10 performs the initial operation, the MFP 10 can shorten the rise time of the apparatus.

Second Embodiment

An image forming apparatus of a second embodiment is a color printing MFP. The image forming apparatus of this embodiment has substantially the same structure as the structure of the MFP 10 except for a color print process part.

The image forming apparatus of this embodiment includes a fixing unit 15, and is the color MFP using the electrophotographic system. The fixing unit 15 includes a heat roller 22 and a press roller 23 which are different in heat capacity. The heat roller 22 and the press roller 23 are arranged to face each other. The fixing unit 15 includes a heating member (heat generating layer 22*c*, halogen lamp 62) provided in the respective rollers, and a detection device (temperature sensor 66, protecting element 67) to detect roller temperatures of the respective rollers.

A method of performing an initial process in the image forming apparatus of the second embodiment is a method of performing the initial process at the time of start-up, after a setting number of sheets are printed, or after the image forming apparatus is left for a while.

Figure 9:
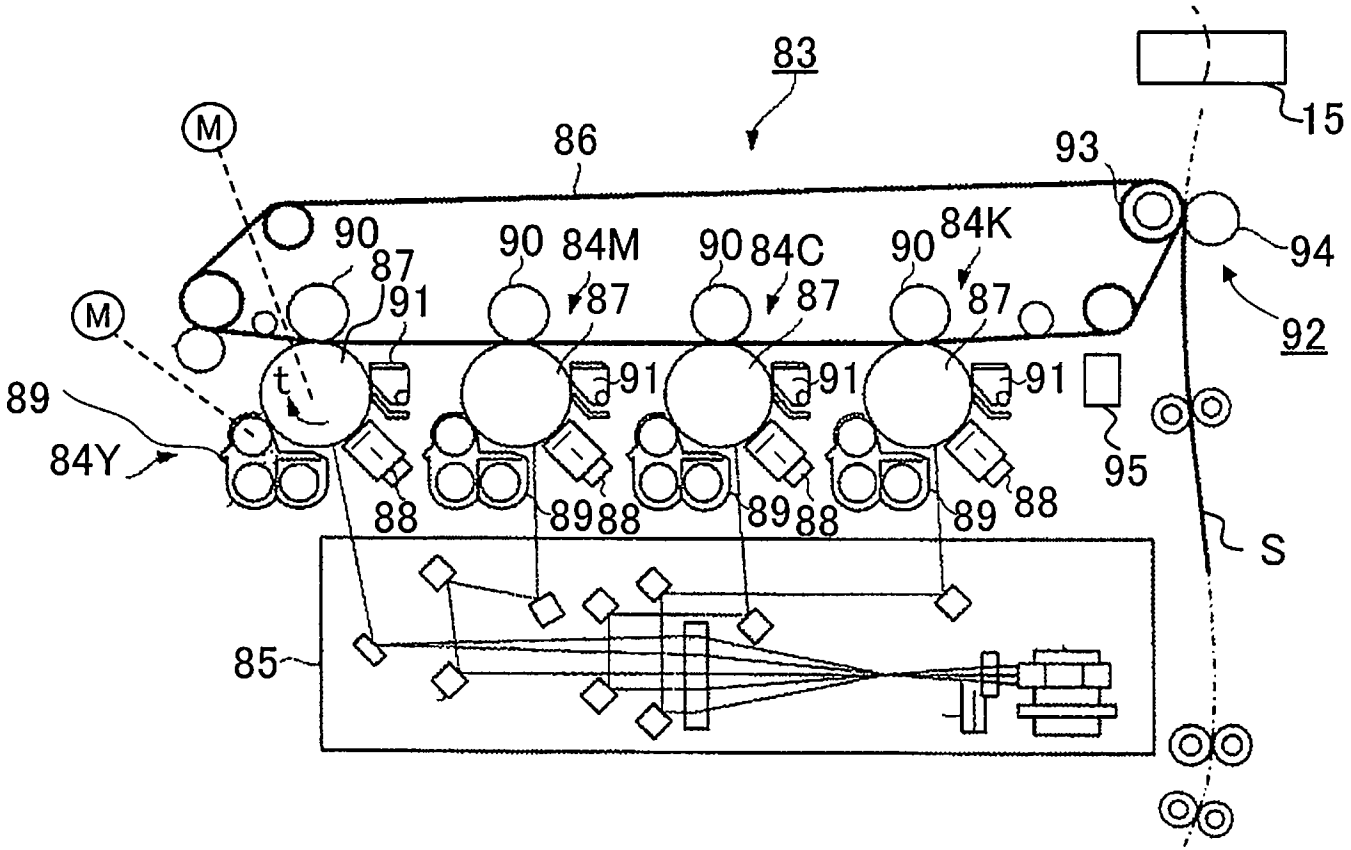
FIG. 9 is an enlarged view of a print process part used in an image forming apparatus according to a second embodiment.

FIG. 9 is an enlarged view of a print process part used in the image forming apparatus according to this embodiment. The same reference characters as already described ones denote the same components.

A print process part 83 includes an image forming part 84Y for yellow (Y), an image forming part 84M for magenta (M), an image forming part 84C for cyan (C), an image forming part 84K for black (K), a laser exposure device 85 and a belt 86.

The image forming part 84Y includes a photoconductive drum 87, a charging unit 88, a developing unit 89, a primary transfer unit 90 and a cleaner 91.

The photoconductive drum 87 carries a latent image thereon. The charging unit 88 charges the photoconductive drum 87. The developing unit 89 develops a latent image formed on the photoconductive drum 87. The developing unit 89 is filled with a two-component developer of yellow. The developing unit 89 is coupled to the toner cartridge for yellow through a reception port or a toner conveyance path.

The primary transfer unit 90 is a roller to transfer a toner image developed on the photoconductive drum 87 onto the belt 86. The belt 86 is an intermediate transfer body. The belt 86 travels counterclockwise in the drawing. The cleaner 91 cleans the surface of the photoconductive drum 87 after transferring.

The structures of the image forming parts 84M, 84C and 84K are substantially the same as the structure of the image forming part 84Y.

The laser exposure device 85 irradiates laser light to the respective photoconductive drums 87 of the image forming parts 84Y, 84M, 84C and 84K. The laser exposure device 85 reduces the potentials of portions of the surfaces of the respective photoconductive drums 87 to which the laser light is irradiated.

The print process part 83 includes a secondary transfer unit 92. The secondary transfer unit 92 nips a sheet S in cooperation with the belt 86. The secondary transfer unit 92 includes a backup roller 93 and a secondary transfer roller 94.

The secondary transfer unit 92 applies a secondary bias voltage to the backup roller 93. The secondary transfer unit 92 secondarily transfers a color toner image onto the sheet.

A power source is applied to the image forming apparatus of the embodiment having the foregoing structure. For example, in a warming-up mode, a system control part 18 sets a target value of fixation heating temperature.

The image forming apparatus measures roller temperatures of the heat roller 22 and the press roller 23 substantially similarly to the example of FIGS. 4 to 6B.

The system control part 18 compares a temperature difference between the respective roller temperatures with a threshold. The system control part 18 obtains an arrival time difference between a time when the heat roller 22 reaches a heat roller ready temperature and a time when the press roller 23 reaches a press roller ready temperature.

The system control part 18 determines whether the arrival time difference is longer than a processing time required to perform the initial process.

When the system control part 18 estimates that the arrival time difference is longer than the processing time, the initial process is performed.

An example of image quality maintenance when the image forming apparatus of the present embodiment is the color machine will be described. Image data from an image processing part 13 has a gradation characteristic. The gradation characteristic means color reproducibility. The system control part 18 corrects the gradation according to the characteristics of developers of four colors.

The system control part 18 causes a print process part 14 to form four-color gradation patch patterns on the belt 86. The system control part 18 measures toner pattern bands by a toner attachment amount sensor 95.

From a gradation correction table of a ROM 32, the system control part 18 selects a gradation density within a range in which detected density falls among gradation densities of plural stages. The print process part 14 updates the gradation correction table. The image quality is maintained.

In the color machine, the initial process includes an alignment process to align test image pattern positions of the respective colors. The system control part 18 generates four lines of four-color test patterns on the belt 86. One or plural reflection light sensors apply light to the respective patterns. The system control part 18 determines the presence or absence of a position shift based on reflected light.

During the initial operation, the power consumption of the image forming apparatus includes initializing power, heat roller temperature keeping power, press roller heating power and apparatus power. The amount of power is smaller than the power upper limit.

The system control part 18 monitors whether the roller temperature of the press roller 23 reaches the press roller ready temperature.

When detecting that the press roller 23 reaches the press roller ready temperature, the system control part 18 sets the heating power for the press roller 23 to a lower value of press roller temperature keeping power.

The system control part 18 starts to keep the respective roller temperatures of the heat roller 22 and the press roller 23.

Similarly to the example of FIG. 5B, the image forming apparatus does not perform the initial process during the period from time point (II) to time point (A). The image forming apparatus performs the initial process during the period from time point (A) to time point (B).

The image forming apparatus does not perform the initial process during the period from time point (II) to time point (A). The image forming apparatus shifts the initial process to the period from time point (A) to time point (B). The image forming apparatus can cause the total amount of power required for the initial process to be lower than the power upper limit.

The total amount of power includes apparatus power, press roller heating power, heat roller temperature keeping power and initializing power. The total amount of power does not exceed the power upper limit.

Thereafter, when the system control part 18 detects a print job, the system control part 18 starts printing.

After the image forming apparatus prints and outputs several thousand sheets, or the image forming apparatus is left for a while, the image forming apparatus performs the initial process. Also in this case, the same process is performed.

Others

The set values of the respective temperatures can be variously changed.

In the above embodiment, although the press roller 23 incorporates the heater, a heat generating layer is provided as a heater in the press roller 23 and induction heating can also be performed.

A thermopile may be used as the temperature sensor 66.

In the above embodiment, the content of the initial process is varied. As an example, the initial process includes rotation of the augers 52 and 53 in the developing unit 45, rotation of a polygon mirror in the scanner part 12, rotation of the photoconductive drum 43, and charging of the photoconductive drum 43.

In the above embodiment, the MFP 10 sets the setting in the example in which the heat capacity of the heat roller 22 is smaller than the heat capacity of the press roller 23, and the heating power for the press roller 23 is lower than the heating power for the heat roller 22. This setting is based on a way to one of ordinary skill in the art.

In the image forming apparatus of the embodiment, the heat capacity of the heat roller 22 and the heat capacity of the press roller 23 have only to be different from each other. Besides, in the image forming apparatus, the heating power for the press roller 23 may be equal to or larger than the heating power for the heat roller 22.

In the above embodiment, although the toner image is directly transferred to the sheet, in the image forming apparatus of the embodiment, the toner image is transferred onto a transfer belt, and the toner image may be transferred to the sheet from the transfer belt. The initial process when the intermediate transfer belt is used includes traveling of the transfer belt and application of a voltage to the transfer belt.

In the above embodiment, since the suitable temperature of the fixing unit 15 is changed by the temperature and humidity of a room where the main body 11 is installed, the content of the initial process can be variously changed according to the environment of the room where the main body is installed.

The unit of temperature may be Fahrenheit.

The image forming apparatus may be a copy machine or a printer using an electrophotographic system.

While certain embodiments have been described, these embodiments have been presented by way of example only, and are not intended to limit the scope of the inventions. Indeed, the novel methods and systems described herein may be embodied in a variety of other forms; furthermore various omissions and substitutions and changes in the form of methods and systems described herein may be made without departing from the spirit of the inventions. The accompanying claims and their equivalents are intended to cover such forms or modifications as would fall within the scope and spirits of the inventions.

What is claimed is:

1. An image forming apparatus comprising:

a print process part configured to form a not yet fixed developer image on a sheet;

a heat roller configured to include a heating element, generate heat to the developer image on the sheet from the print process part and raise a first roller temperature by the heating element from a reference temperature to a first specified temperature;

a press roller configured to press the sheet in cooperation with the heat roller, include a heater, and raise a second roller temperature by the heater from the reference temperature to a second specified temperature;

a power source part configured to have a power upper limit value that is smaller than a sum of heating power required to heat the heat roller and the press roller plus initial power to adjust an image forming process condition and is larger than the heating power;

a power source control part configured to control a distribution amount of the heating power to the heating element and the heater to prevent an amount of power supplied by the power source part from exceeding the power upper limit value and control supply or stop of the initial power;

a plurality of temperature sensors configured to detect respective roller temperatures of the heat roller and the press roller; and a determination part configured to determine necessity of supplying the initial power by the power source control part based on a temperature difference between the respective roller temperatures detected by the respective temperature sensors.

2. The apparatus of claim 1, wherein when the temperature difference is smaller than a previously stored threshold, the determination part configured to cause the power source control part to start the supply of the initial power when the first roller temperature reaches the first specified temperature.

3. The apparatus of claim 2, wherein when the temperature difference is larger than the threshold, the determination part configured to prevent the power source control part from supplying the initial power.

4. The apparatus of claim 1, wherein the determination part configured to estimate whether an arrival time difference between a time when the first roller temperature reaches the first specified temperature and a time when the second roller temperature reaches the second specified temperature is longer than a processing time required to perform an initial process.

5. The apparatus of claim 4, wherein the heat roller configured to require a first heating time for a heating process to raise the first roller temperature from the reference temperature to the first specified temperature, and the press roller configured to require a second heating time, which is longer than the first heating time, for a heating process to raise the second roller temperature from the reference temperature to the second specified temperature, and when the arrival time difference is longer than the processing time, the determination part configured to cause the power source control part to start the supply of the initial power in a period from an end of the first heating time to an end of the second heating time.

6. The apparatus of claim 5, wherein the power source control part configured to perform power control in the period and cause a sum of the initial power, temperature keeping power to keep the first roller temperature, the heating power distributed to the press roller, and print process power supplied to the print process part to be smaller than the power upper limit value.

7. The apparatus of claim 4, wherein the heat roller configured to have a first heat capacity, the press roller configured to have a second heat capacity larger than the first heat capacity, and the determination part configured to estimate a first heating time required for a heating process to raise the first roller temperature from the reference temperature to the first specified temperature according to a heat generation amount of the heating element and the first heat capacity, estimate a second heating time required for a heating process to raise the second roller temperature from the reference temperature to the second specified temperature according to the heat generation amount and the second heat capacity, and estimate the arrival time difference.

8. The apparatus of claim 7, wherein when the arrival time difference is longer than the processing time, the determination part configured to cause the power source control part to start the supply of the initial power in a period from an end of the first heating time to an end of the second heating time.

9. The apparatus of claim 8, wherein the power source control part configured to perform power control in the period and causes a sum of the initial power, temperature keeping power to keep the first roller temperature, the heating power distributed to the press roller, and print process power supplied to the print process part to be smaller than the power upper limit value.

10. The apparatus of claim 4, wherein when the arrival time difference is shorter than the processing time, the determination part configured to prevent the power source control part from supplying the initial power.

11. The apparatus of claim 4, wherein the determination part configured to determine the first specified temperature and the second specified temperature based on a toner fixing characteristic of the developer image on the sheet.

12. The apparatus of claim 1, wherein the determination part configured to determine necessity of supplying the initial power when a power source is applied to the image forming apparatus in an off state.

13. The apparatus of claim 1, wherein the determination part configured to determine necessity of supplying the initial power when a state of the image forming apparatus deviates from the image forming process condition.

14. A method of performing an initial process in an image forming apparatus, comprising:

detecting respective roller temperatures of a heat roller and a press roller;

determining necessity of supplying initial power for adjusting an image forming process condition based on a temperature difference between the respective roller temperatures;

heating the heat roller and the press roller at maximum power amount within a range not exceeding a power upper limit value that is smaller than a sum of heating power to the heat roller and the press roller plus the initial power and is larger than the heating power; and starting to supply the initial power when a determination result indicates that the supplying is necessary and when the first roller temperature reaches a first specified temperature.

15. The method of claim 14, further comprising:

preventing, in the determination of the necessity, the supply of the initial power when the temperature difference is larger than a previously stored threshold.

16. The method of claim 14, further comprising:

estimating, in the determination of the necessity, whether an arrival time difference between a time when the first roller temperature reaches a first regulated time and a time when the second roller temperature reaches a second specified temperature is longer than a processing time required to perform the initial process.

17. The method of claim 16, wherein in the estimation, a first heating time required for a heating process to raise the first roller temperature from a reference temperature to the first regulated time is estimated from a heat generation amount of a heat generating body provided in the heat roller and a heat capacity of the heat roller; and a second heating time required for a heating process to raise the second roller temperature from the reference temperature to the second specified temperature is estimated from the heat generating amount and a heat capacity of the press roller.

18. The method of claim 17, further comprising:

starting, in the supply of the initial power, the supply of the initial power in a period from an end of the first heating time to an end of the second heating time.

19. The method of claim 18, further comprising:

performing power control, in the supply of the initial power, to cause a sum of the initial power, temperature keeping power to keep the first roller temperature, the heating power distributed to the press roller, and print process power supplied to a print process part to become smaller than the power upper limit value in the period.

20. The method of claim 14, wherein the determination of the necessity is performed when a power source is applied to the image forming apparatus in an off state or when a state of the image forming apparatus deviates from the image forming process condition.

* * * * *